United States Patent [19]

Nichols

[11] 4,352,362

[45] Oct. 5, 1982

[54] TENT APPARATUS AND METHOD

[76] Inventor: Philip T. Nichols, P.O. Box 151362, Salt Lake City, Utah 84115

[21] Appl. No.: 185,710

[22] Filed: Sep. 10, 1980

[51] Int. Cl.[3] ..... A45F 1/16

[52] U.S. Cl. ..... 135/3 E; 135/4 R

[58] Field of Search ..... 135/1 R, 2, 3 E, 4 R

[56] References Cited

U.S. PATENT DOCUMENTS

| | | | |
|---|---|---|---|
| 1,502,898 | 7/1924 | Berg | 135/2 X |
| 2,543,684 | 2/1951 | Blanchard | 135/3 E X |
| 3,168,101 | 2/1965 | Porter | 135/3 E X |
| 3,223,098 | 12/1965 | Dole | 135/3 E |
| 3,794,054 | 2/1974 | Watts | 135/2 |
| 3,834,410 | 9/1974 | Leibel | 135/3 E |
| 4,192,333 | 3/1980 | Sato | 135/3 E |
| 4,193,413 | 3/1980 | Watts et al. | 135/2 |

FOREIGN PATENT DOCUMENTS

| | | | |
|---|---|---|---|
| 7708497 | 2/1978 | Netherlands | 135/3 E |

*Primary Examiner*—J. Karl Bell

*Attorney, Agent, or Firm*—J. Winslow Young; H. Ross Workman; Allen R. Jensen

[57] ABSTRACT

A novel tent apparatus and method, the tent apparatus including a first tent shell having sidewalls and a floor. The support structure for the tent shell includes a plurality of interconnectable pole structures and an external, umbrella-type rib structure for placing the tent poles in an outwardly directed tension. The tent pole structure is integrally joined to the tent shell so as to provide a unitary, man-portable and erectable tent structure.

20 Claims, 8 Drawing Figures

TENT APPARATUS AND METHOD

BACKGROUND

1. Field of the Invention

This invention relates to tents and, more particularly, to a novel tent apparatus and method, the apparatus including improvements in a self-contained tent support structure configurated as an integral part of the tent.

2. The Prior Art

Numerous tent structures are known in the art and include various forms of support structure for supporting the material of the tent in the desired configuration. Since the primary function of a tent is to provide a portable, temporary shelter and generally includes a fabric roof/sidewall configuration with an optional floor, various support structures have been proposed for supporting the fabric enclosure. For example, two types of framing structures are shown in each of U.S. Pat. Nos. 3,168,101 and 3,834,410. The former patent is relevant in that it discloses an external frame for a tent while the latter patent relates to a collapsible tent structure wherein the framework is fabricated with spring-loaded cables passing through the center of hollow pole elements. A similar folding tent is also shown in U.S. Pat. No. 2,543,684. U.S. Pat. No. 1,590,213 discloses a tetrahedral-shaped tent having a rigid pole at each corner of the tetrahedral shape.

U.S. Pat. Nos. 1,502,898 and 3,794,054 relate to tent structures which are generally referred to in the art as umbrella-type tents. In particular, the lateral spars or ribs of the "umbrella" structure intersect with downwardly extending legs to provide the roof structure for the tent. The umbrella tent of the latter patent has the additional advantage in that an over-center action is obtained by pushing the central support column 20 upwardly into an over-center position, the over-center position forcing the poles to be bowed outwardly under tension thereby providing the appropriate structural configuration of the tent. However, with respect to this latter feature, it is well-known that a tent of any substantial dimensions requires a correspondingly increased amount of force in order to accomplish the foregoing placement of the poles under the outwardly bowed tension sufficient to maintain the structural integrity of the tent. In particular, the force required to erect a large tent having six poles wherein each are simultaneously placed under tension by an outwardly directed force utilizing the mechanism of U.S. Pat. No. 3,794,054 would be substantially in excess of the amount of force that could be applied by any single individual. The force necessary to accomplish the foregoing can be readily calculated by taking into account the stiffness of the various poles, the number of poles, the weight of the tent, as well as the point at which the force is applied to the tent poles. For example, with respect to the latter consideration, attention is directed to the foregoing tent structure of U.S. Pat. No. 3,794,054 wherein it will be noted that the force is applied approximately midway between the joints of the folding tent pole structure thereby decreasing at least by half the leverage distance that would otherwise be available.

In view of the foregoing, it would be an advancement in the art to provide a novel, folding tent structure wherein the poles are configurated as an integral part of the tent structure. Another object of this invention would be to provide a novel umbrella-type tent structure wherein the umbrella mechanism for the tent structure is located externally and is individually and sequentially operable to thereby accommodate a tent structure having substantially greater dimensions than any of the prior art tent structures. Such a novel tent apparatus and method is disclosed and claimed herein.

BRIEF SUMMARY AND OBJECTS OF THE INVENTION

The present invention relates to a novel tent apparatus and method, the tent apparatus being configurated as an externally supported, umbrella-type tent. The support structure for the fabric tent shell of this invention is a novel, externally-mounted, umbrella-type structure. The rib structure for the tent pole system is individually operable in a sequential manner to thereby decrease the erection forces for the tent by an amount corresponding generally to the number of poles for the tent structure. A novel bottom tab arrangement is also included in the tent structure of this invention to accommodate pole manipulation during separation of the poles upon collapsing the tent.

It is, therefore, a primary object of this invention to provide improvements in tent structures.

Another object of this invention is to provide an improved method for supporting a tent structure.

Another object of this invention is to provide an improved method for erecting a tent with minimal required force.

Another object of this invention is to provide a novel method for erecting a tent structure.

Another object of this invention is to provide a portable tent structure having an externally mounted, umbrella-type support structure.

Another object of this invention is to provide a manportable tent of the umbrella type and configurated so as to incorporate the support structure as an integral unit with the fabric tent shell.

Another object of this invention is to provide a novel tab attachment site for each tent pole to provide a device for extending the effective length of the fabric structure during disassembly of the respective tent pole.

These and other objects and features of the present invention will become more fully apparent from the following description and appended claims taken in conjunction with the accompanying drawing.

DETAILED DESCRIPTION OF THE PREFERRED EMBODIMENTS

Figure 1:
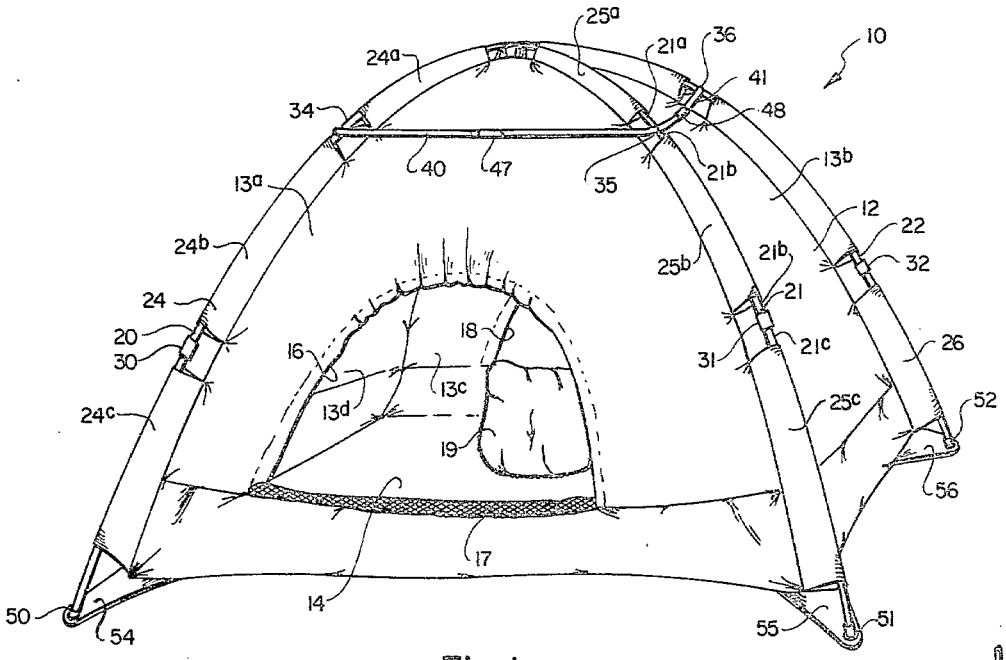
FIG. 1 is a perspective view of the novel tent structure of this invention.

The invention is best understood by reference to the drawing wherein like parts are designated with like numerals throughout.

Referring now more particularly to FIG. 1, the novel tent structure of this invention is shown generally at 10 and includes a fabric tent shell 12 having sidewall roof structure 13 assembled from discrete sidewalls 13*a*–13*d* and a floor 14. Floor 14 is joined along common seams with each of the sidewalls 13*a*–13*d* and thereby completes the unitary structure of tent shell 12. A door 16 is formed in sidewall 13*a* and is configurated with a conventional, zipper-closed door/screen structure 17 (shown folded for ease of illustration). A corresponding window 18 having a zipper-secured closure 19 is formed in an opposite sidewall 13*c*. Sidewalls 13*a*–13*d* are joined along abutting seams having a web structure formed as sleeves 24–27 secured as an integral part thereof. Sleeves 24–27 serve as hollow receivers for tent poles 20–23 to provide a web support between tent poles 20–23 and tent shell 12, as will be discussed more fully hereinafter.

Figure 2:
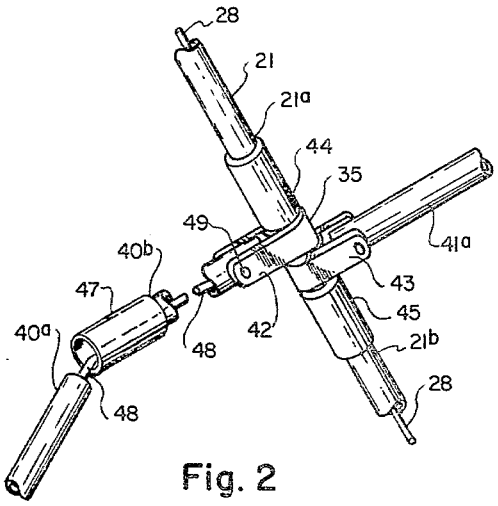
FIG. 2 is a perspective view of a rib interconnection with a tent pole.
Figure 3:
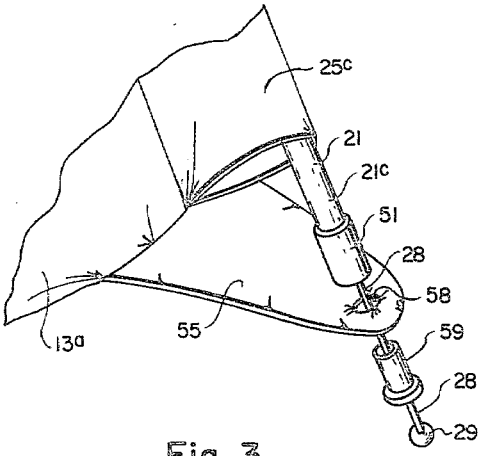
FIG. 3 is a partial, exploded, perspective view of the floor tab/tent pole interlock system.
Figure 5:
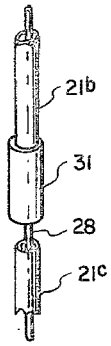
FIG. 5 is a partial, exploded, perspective view of a joint in a tent pole.
Figure 4:
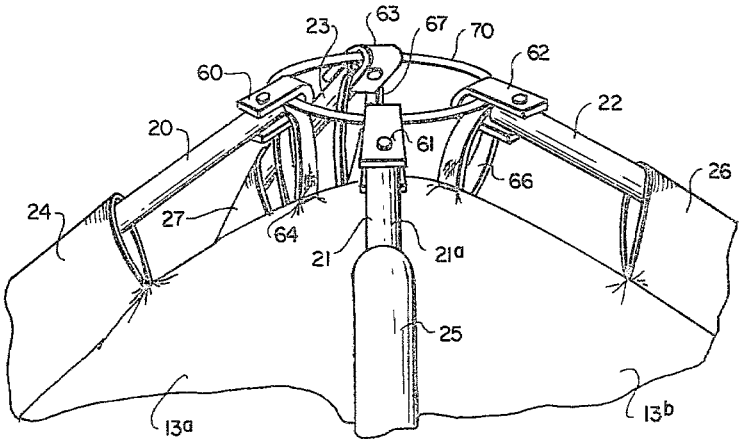
FIG. 4 is a perspective view of the upper interconnect system of the tent support structure.

Tent shell 12 is supported in the illustrated, erect position by tent poles 20–23 and four, interconnecting, lateral ribs, only two of which are shown herein as ribs 40 and 41. Tent poles 20–23 and ribs 40 and 41 are each configurated as hollow tubular elements having an elastic cord passing through the center thereof. Each of tent poles 20–23 is configurated to be disassembled into at least three sections, as will be seen more fully hereinafter with respect to a detailed description of tent pole 21 as seen in FIG. 1 and also with additional reference to FIG. 5. In particular, tent pole 21 includes tent pole sections 21*a*–21*c* which are fabricated from a suitable material having a limited degree of flexibility while retaining desired strength characteristics sufficient to support tent shell 12 and otherwise accommodate the various features of this invention. For example, in a first preferred embodiment of the novel tent structure of this invention, tent poles 20–23 were fabricated from lengths of fiberglass tubing having an external dimension of about three-eighths inch and an internal throughbore of sufficient diameter to accommodate three-sixteenths inch elastic cords 28 and 48 (FIGS. 2, 3, and 5). The lower end of pole segment 21*b* includes a socket 31 for the upper end of pole segment 21*c*. The elasticity of elastic cord 28 pulls the upper end of pole segment 21*c* into socket 31 to thereby securely interlock pole segment 21*c* coaxially with pole segment 21*b* completing the lower portion of tent pole 21. The reverse operation permits folding of tent pole 21 by the operator (not shown). Folding or disassembly of tent pole 21 is done by the operator (not shown) supplying sufficient longitudinal force to pole segments 21*b* and 21*c* to overcome the elasticity of elastic cord 28 and thereafter folding tent pole segment 21*c* over elastic cord 28 and parallel to tent pole segment 21*b* to provide the desired folding characteristics for tent pole 21. Similar features are also found for each of joints 30 and 32 of tent poles 20 and 22, respectively. Similar features are also found (but are not shown) for tent pole 23 (FIG. 4).

Similar joints are also shown at joints 34–36. In particular and with particular reference to FIG. 2, joint 35 is shown more fully and includes a socket 45 for receipt of the upper end of pole segment 21*b* therein in a manner similar to that set forth with respect to joint 31 (FIG. 5). The upper portion of joint 35 is also configurated with a sleeve 44 that has the lower end of pole segment 21*a* passing therethrough. Joint 35 also provides interconnection for ribs 40 and 41 with tent pole 21 for the novel, umbrella-type structure of this invention. Rib 40 is configurated with two rib sections 40*a* and 40*b* which are configurated similar to tent poles 20–23 and includes an elastic cord 48 extending through the hollow center thereof. The midpoint of rib 40 is configurated with a joint 47 operationally similar to joint 31 (FIG. 5). The right end of rib segment 40*b* is hingedly and swivelly joined to tent pole 21 by a swivel 42. Swivel 42 includes a pivot pin 49 to accomodate rib segment 40*b* being folded upwardly into a position generally parallel to tent pole segment 21*a*. Swivel 42 also allows rib segment 40*b* to be rotated transversely about the axis of tent pole 21. A similar swivel 43 is found on the left end of rib segment 41*a*. The length of rib 40 is selectively predetermined so as to place the appropriate amount of outward distension against the respective tent poles 20 and 21. In particular, rib 40 extends transversely between tent poles 20 and 21 with sufficient length to cause tent poles 20 and 21 to be bent outwardly (FIG. 1).

The seam between each of sidewalls 13*a*–13*d* includes outwardly extending, open sleeves 24–27, respectively. Sleeves 24–27 are configurated as support webs for tent shell 12 and receive therein tent poles 20–23, respectively. Sleeves 24–27 are each prepared with discrete sleeve segments 24*a*–24*c*, 25*a*–25*c*, etc. For example, sleeve segments 25*a*–25*c* receive therein pole segments 21*a*–21*c*, respectively, of tent pole 21. The spaces between sleeve segments 25*a* and 25*b* as well as 25*b* and 25*c* receive therein joints 35 and 31, respectively. These spaces permit the operator (not shown) to manually assemble and disassemble joints 35 and 31 and, correspondingly, tent pole 21.

Figure 8:
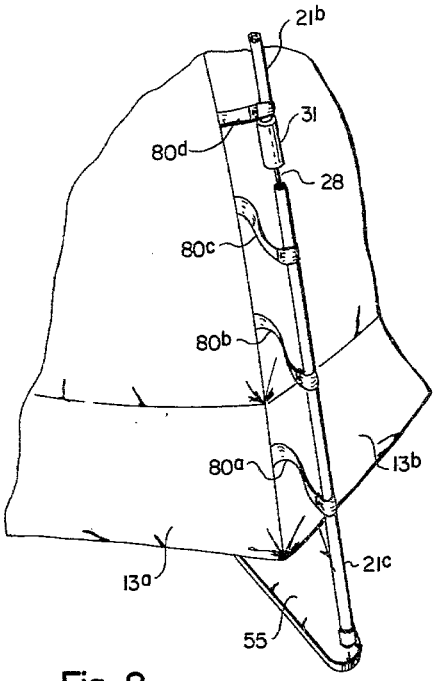
FIG. 8 is a partial, perspective view of the embodiment of FIG. 6 in a relaxed configuration prior to disassembly of the tent pole.
Figure 7:
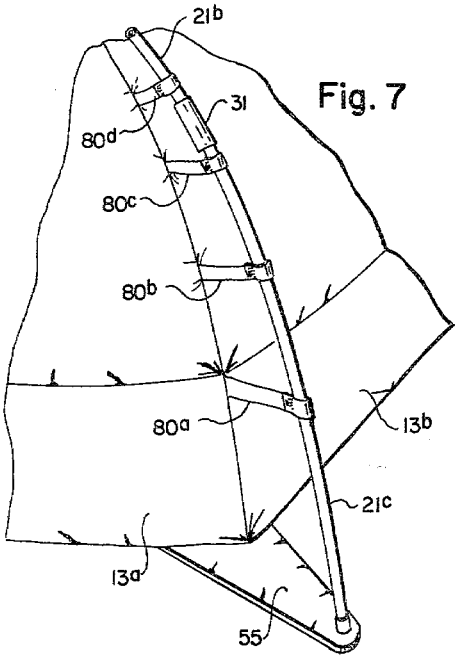
FIG. 7 is a partial, perspective view of a second preferred embodiment of the web support system of this invention in a support configuration.

With particular reference now to FIGS. 7 and 8, a second preferred embodiment of the support web system of this invention is shown and includes a plurality of support straps 80*a*–80*d* mounted along the seam between tent sidewalls 13*a* and 13*b*. Support straps 80*a*–80*c* are attached to tent pole segment 21*c* while support strap 80*d* is attached to tent pole segment 21*b*. Support straps 80*a*–80*d* provide the necessary support web system for tent pole 21 by supporting the tent therefrom. With particular reference to FIG. 8, the support system of support straps 80*a*–80*d* is particularly useful when sleeves 24–27 (FIG. 1) are wet and do not slip easily along tent poles 20–23, respectively, during assembly and disassembly of tent poles 20–23. In particular, straps 80*a*–80*d* fold downwardly along with tab 55 to allow joint 31 to be separated. This is readily accomplished when the outward bending forces supplied by ribs 40 and 41 (FIG. 1) and the remaining ribs (not shown) are released to allow tent poles 20–23 to become straight again. Straightening of tent poles 20–23 causes them to elongate slightly relative to the adjacent length of tent shell 12 thereby folding tab 54–56 (FIG. 1) downwardly from the plane of floor 14 (FIG. 1). Additional elongation is provided by tabs 54–56 (FIG. 1) folding further out of the plane of floor 14 (FIG. 1) thereby allowing each of the respective joints to be separated as set forth hereinbefore.

Clearly, tab 55 may be fabricated as a strap similar to straps 80*a*–80*d* as long as the subject strap is mounted so as to be coplanar with floor 14 (FIG. 1). In this manner, tab 55 and/or the particular strap furnishes the necessary securement for the bottom of tent pole to tent shell 12 (FIG. 1) and causes tent floor 14 (FIG. 1) to be incorporated into the overall support structure as a tension member.

Figure 6:
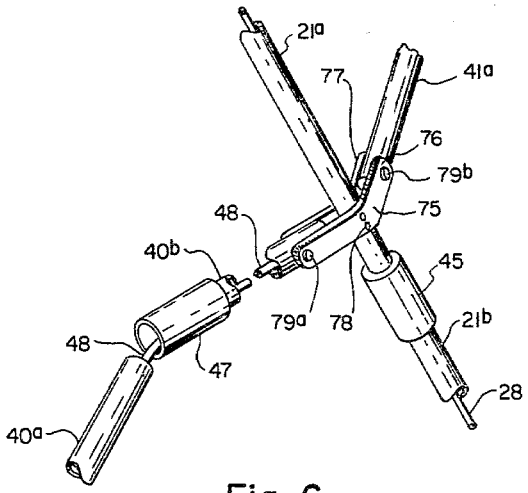
FIG. 6 is a perspective view of a second preferred embodiment of the rib interconnection with a tent pole.

With particular reference to FIG. 6, a second preferred joint system for joining rib segments 40*b* and 41*a* to tent pole 21 is shown as joint system 75. Joint system 75 is fabricated from two, coplanar angle members 76 and 77 riveted to the lower end of tent pole segment 21*a* by rivets 78. Rib segments 40*b* and 41*a* are pivotally mounted between angle members 76 and 77 by pivot pins 79*a* and 79*b*. Pivot pins 79*a* and 79*b* allow the respective rib segments to be pivoted upwardly parallel to tent pole segment 21*a*. A socket 72 on the lower end of tent pole segment 21*a* receives the upper end of tent pole segment 21*b*.

Referring now more particularly to FIG. 3, one presently preferred embodiment for attaching the lower end of tent pole 21 to tent shell 12 is shown by the exploded view of the lower end of tent pole 21 or, more particularly, tent pole segment 21*c*. The lower end of tent pole segment 21*c* terminates in a foot 51 having an enlarged diameter that is adapted to rest against tab 55 in abutting relationship against an aperture 58 in tab 55. The internal dimensions of foot 51 are such as to receive a plug 59 in telescopic relationship. Plug 59 passes through aperture 58 so as to securely engage tab 55 between foot 51 and plug 59. The lower end of elastic cord 28 terminates in a knot 29 to preclude elastic cord 28 being pulled through plug 59.

Referring now to FIG. 4, the upper ends of tent poles 20–23 are interconnected by means of a ring 70 to which each of tent poles 20–23 are securely joined by means of couplings 60–63, respectively. Fabric loops 64–67 interconnect the fabric of sidewalls 13*a*–13*d* and, more particularly, tent shell 12 to tent poles 20–23 by passing through each of couplings 60–63, respectively. Loops 64–67 secure tent shell 12 to tent poles 20–23 so that when tent poles 20–23 are foreshortened as set forth hereinbefore and brought together into a bundle of parallel tent pole segments, tent shell 12 will be prevented from sliding down tent poles 20–23.

The various features set forth hereinbefore with respect to each of FIGS. 2–8 will be discussed more fully hereinafter when discussing the erection and folding of tent structure 10.

Tent structure 10 is folded by the operator sequentially releasing joints 47 and 48 for the respective ribs 40 and 41. Similar rib joints on the other side of tent apparatus 10 are also released. Release of the respective ribs is accomplished by pulling apart the individual rib sections against the tension of elastic cord 48 (FIG. 2) in combination with the bowing tension on the respective tent poles and folding the respective rib segments upwardly and generally parallel to the corresponding, adjacent tent pole segments. With each of the ribs released, the outward tension against each of tent poles 21–23 is completely released. Thereafter, the floor 14 is raised upwardly causing each of tabs 54–56 to be folded downwardly out of the plane of floor 14. The length of tabs 54–56 is sufficient to provide a relaxing of the transverse tension against each of tent poles 20–23 to allow the operator to bring tent poles 20–23 generally parallel and also release the various tent pole sections at joints 30–32 and joints 34–36. Each of the joints is released by separating the respective tent pole segments against the tension of elastic cord 28 (FIGS. 2, 3 and 5) thereby allowing each respective pole segment to be folded into a parallel relationship with the next succeeding tent pole segment. For example, tent 10 is folded by the operator (not shown) separating joints 34–36 and folding to one side the upper section of tent 10. Thereafter, by following a similar procedure, the lower section of tent 10 is folded to the other side of the middle section to present a general S configuration. In this manner, the entire structure of tent 10 may be folded into a package having an overall length approximately equal to the length of the respective tent pole segments. Thus folded, tent structure 10 occupies a relatively compact space and may be readily transported from place to place.

The erection of tent apparatus 10 is readily accomplished by reversing the foregoing sequence. In particular, each of the respective tent pole segments is unfolded and the respective tent pole segments of tent poles 20–23 are joined at the respective joints 34–36 and 30–32. With the tent poles 20–23 now assembled, the necessary outward tension is placed against each of the respective tent poles by bringing the respective ribs, ribs 40 and 41, into a generally horizontal position, for example, by joining rib segment 40*a* to rib segment 40*b* in socket 47. The corresponding rib 41 between tent poles 21 and 22 as well as the remaining ribs (not shown) between each of tent poles 22 and 23 as well as tent poles 23 and 20 may be sequentially adjusted as set forth hereinbefore to provide the necessary, outwardly directed bending action against tent poles 20–23. The outward bending action on tent poles 20–23 is resisted by tension directed transversely through floor 14 so as to provide a substantially secure and stable external support structure for tent shell 12.

Placement of joint 35 for rib 40 at the interconnection of pole segments 21*a* and 21*b* permits the operator (not shown) to exert maximum leverage against tent poles 20 and 21 during assembly and disassembly of rib 40. This means that tent structure 10 can be fabricated with any suitable dimension without exceeding the strength capacity of a single operator. Further, the novel apparatus of this tent structure 10 permits the operator (not shown) to assemble only one rib at a time.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A tent comprising:

a fabric tent shell comprising a plurality of sidewalls, each sidewall joined to the adjacent sidewall in side-by-side relationship along a seam, and an integral floor structure joined to a lower edge of said sidewall;

web means mounted to the fabric tent shell;

a tab extending from the floor adjacent each web means, the tab being coplanar with the floor;

a foldable tent pole means secured to the web means;

coupling means for joining the upper ends of the tent pole means;

attachment means at the lower end of the tent pole means for attaching the tent pole means to each of said tabs; and rib means extending transversely between each of adjacent said tent pole means, each of said rib means having sufficient length to bend said adjacent tent pole means outwardly.

2. The tent defined in claim 1 wherein the web means comprise a plurality of open-ended sleeves along each seam, each sleeve loosely receiving a tent pole therein to accommodate relative movement between the tent pole inserted in the sleeve and the tent shell.

3. The tent defined in claim 2 wherein the foldable tent pole means comprises a plurality of tubular tent pole elements adapted to be joined end-to-end at a joint into a unitary tent pole and an elastic cord means extending through the hollow lumen of each of said tent pole segments.

4. The tent defined in claim 3 wherein each of said sleeves comprises a plurality of spaces therein, each of said spaces providing access to a joint in said tent poles.

5. The tent defined in claim 1 wherein the web means comprises a plurality of straps interconnected between the tent shell and the foldable tent pole means.

6. The tent defined in claim 1 wherein the coupling means comprises a ring member with the upper end of each tent pole coupled thereto and the tent shell comprises securement means for securing the tent shell to the coupling means.

7. The tent defined in claim 1 wherein the attachment means comprises an attachment means on the lower end of the tent pole for attaching the tab to the tent pole, the tab having a length sufficient to accommodate being folded downwardly from the plane of the floor to permit the tent pole to be disassembled into a foldable tent pole.

8. The tent defined in claim 1 wherein the rib comprises a pluality of rib members interconnected laterally between said adjacent tent poles, each rib member being configurated as a pair of rib segments, the opposite ends of each rib segment being hingedly joined to a tent pole and adapted to be interlocked to form the rib member.

9. The tent defined in claim 8 wherein the rib members further comprise hollow tubular rib segments having an elastic cord passing through the center of the hollow rib segments.

10. A tent comprising:

a fabric shelter;

a floor for the fabric shelter;

web support means affixed to the fabric shelter;

a plurality of tabs extending horizontally from the floor adjacent a lower end of the web support means;

a plurality of demountable tent poles mounted to the web support means and secured at a first, lower end to the adjacent tab;

coupling means for coupling the tent poles at a second, upper end; and a plurality of lateral ribs extending between a pair of adjacent tent poles and having a predetermined length so as to force the respective pair of adjacent tent poles to bow outwardly as determined by a line extending between the coupling and the tab.

11. The tent defined in claim 10 wherein the web support means comprise a plurality of open-ended sleeves, each sleeve being adapted to receive a tent pole therein.

12. The tent defined in claim 10 wherein the web support means comprises a plurality of straps interconnected between the fabric shelter and the tent poles, the straps suspending the fabric shelter from the tent poles.

13. The tent defined in claim 10 wherein each of said tent poles comprise a plurality of tent pole segments comprising hollow, tubular elements and an elastic cord passing through the hollow, tubular element, the elastic cord forming a hinge member for the hollow, tubular elements when the tent pole is demounted and as a biasing means for imparting a longitudinal force to the tent pole segments when joined end-to-end into a tent pole and said tabs each having sufficient length to be folded downwardly out of the plane of said floor to permit said tent pole segments to be demounted.

14. The tent defined in claim 10 wherein the coupling means comprises a ring and coupling elements on each tent pole for coupling the tent poles to the ring.

15. The tent defined in claim 10 wherein the coupling means further comprises tether means for tethering the fabric shelter to the coupling means.

16. The tent defined in claim 10 wherein each lateral rib comprises a pair of rib segments, each rib segment being hingeably joined at a first end to an adjacent tent pole and having interlock means at a second end to accomodate interlocking the rib segments into a lateral rib.

17. The tent defined in claim 16 wherein each rib segment is hingeably joined to said adjacent tent pole at a joint in said demountable tent pole.

18. A method for erecting an umbrella-type tent comprising:

preparing a tent structure comprising:

joining a plurality of fabric sidewalls into a tent enclosure by sewing said fabric sidewalls along adjacent seams, said fabric sidewalls converging upwardly at an apex;

attaching a web support system to the seams;

securing a fabric floor to the sidewalls to form a tent shell;

mounting tabs to the tent shell at each seam as extensions of the floor structure, each tab having a length sufficient to accommodate being folded downwardly from the plane of the floor to permit demounting of tent pole segments;

preparing a tent pole support system for the tent shell by interconnecting a plurality of hollow, tubular tent pole segments end-to-end with an elastic cord passing through the hollow center of the tubular tent pole segments;

attaching the tent pole support system to the web support system;

interconnecting the lower end of each tent pole to a tab;

coupling the tent poles at the apex of the tent shell;

tethering the tent shell at the apex to the tent poles; and mounting lateral ribs to the tent poles between adjacent tent poles, the lateral ribs having sufficient length to bend said adjacent tent poles outwardly;

interconnecting preselected tent pole segments end-to-end to form said tent poles;

placing the fabric floor of the tent structure on a surface; and sequentially interlocking each of said rib segments into a lateral rib thereby bending said adjacent poles outwardly as defined by a line between said coupling and said tabs, the outward bending of said tent poles forming a tension arch between the tent pole support system and the floor thereby supporting said tent shell in an erected position.

19. The method defined in claim 18 wherein the interconnecting, placing, and sequentially interlocking steps further comprise folding said tent structure by reversing said interconnecting, placing, and sequentially interlocking steps and thereafter folding each of said tent pole segments in a side-by-side relationship along with said ribs and said fabric sidewalls and said floor to form a readily man-portable bundle.

20. A truss system for externally supporting a tent shell comprising:

a fabric tent shell;

a fabric floor for the tent shell;

a tent pole support structure for the tent shell, the tent pole support structure comprising a plurality of generally vertical tent poles and a plurality of generally horizontal ribs extending between adjacent tent poles and forcing the adjacent tent poles to be bent outwardly, the tent pole support structure forming a support framework for the tent shell;

a support web system for suspending the tent shell inside the support framework; and securement tab means for securing the lower end of each tent pole to the tent shell at a position generally coplanar with the fabric floor thereby incorporating the fabric floor as a tension member for the tent pole support structure.

* * * * *

UNITED STATES PATENT AND TRADEMARK OFFICE

CERTIFICATE OF CORRECTION

PATENT NO. : 4,352,362

DATED : October 5, 1982

INVENTOR(S) : PHILIP T. NICHOLS

It is certified that error appears in the above—identified patent and that said Letters Patent is hereby corrected as shown below:

In the abstract, line 2: "a first tent shell" should be --a fabric tent shell--

Signed and Sealed this

*Twenty-second* Day of *February 1983*

[SEAL]

*Attest:*

GERALD J. MOSSINGHOFF

*Attesting Officer* *Commissioner of Patents and Trademarks*